US009150290B2

(12) United States Patent
Liberg

(10) Patent No.: US 9,150,290 B2
(45) Date of Patent: Oct. 6, 2015

(54) BALLAST SYSTEM

(71) Applicant: Lars-Olof Liberg, Strömstad (SE)

(72) Inventor: Lars-Olof Liberg, Strömstad (SE)

(73) Assignee: GVA CONSULTANTS AB, Gothenburg (SE)

( * ) Notice: Subject to any disclaimer, the term of this patent is extended or adjusted under 35 U.S.C. 154(b) by 62 days.

(21) Appl. No.: 13/949,027

(22) Filed: Jul. 23, 2013

(65) Prior Publication Data

US 2015/0027357 A1 Jan. 29, 2015

(51) Int. Cl.

| | |
|---|---|
| ***B63B 39/03*** | (2006.01) |
| ***B63B 39/06*** | (2006.01) |
| ***B63B 13/00*** | (2006.01) |

(52) U.S. Cl.

CPC ..... *B63B 39/03* (2013.01); *B63B 13/00* (2013.01); *B63B 39/06* (2013.01)

(58) Field of Classification Search

CPC ..... B63B 43/06; B63B 39/03
USPC ..... 114/125; 137/13
See application file for complete search history.

(56) References Cited

U.S. PATENT DOCUMENTS

| | | | | |
|---|---|---|---|---|
| 3,213,632 | A * | 10/1965 | Schuler et al. | 62/53.2 |
| 4,108,574 | A * | 8/1978 | Bartley et al. | 417/19 |
| 5,948,279 | A * | 9/1999 | Chang et al. | 210/808 |
| 6,085,762 | A * | 7/2000 | Barton | 134/25.4 |
| 2003/0205135 | A1 * | 11/2003 | McNulty | 95/263 |
| 2005/0115248 | A1 * | 6/2005 | Koehler et al. | 62/53.1 |
| 2008/0141921 | A1 * | 6/2008 | Hinderks | 114/274 |
| 2010/0101655 | A1 * | 4/2010 | Liberg | 137/13 |
| 2010/0104452 | A1 * | 4/2010 | Liberg | 417/54 |
| 2010/0180810 | A1 * | 7/2010 | Liberg | 114/125 |
| 2011/0126749 | A1 * | 6/2011 | Liberg | 114/125 |

* cited by examiner

*Primary Examiner* — Lars A Olson
*Assistant Examiner* — Jovon Hayes
(74) *Attorney, Agent, or Firm* — Gary M. Machetta

(57) ABSTRACT

The present embodiments relate to ballast systems for marine structures. The ballast system comprises a ballast tank and a pump. The pump comprises a low side and a high side and the ballast system comprises a first inlet conduit assembly adapted to provide a fluid communication between the ballast tank and the low side. The ballast system is adapted to provide a first operating condition in which first operating condition a fluid is pumped from the low side to the high side.

20 Claims, 7 Drawing Sheets

BALLAST SYSTEM

CROSS-REFERENCE TO RELATED APPLICATIONS

This application claims priority to Provisional Patent Application No. 61/109,244 which was filed on Oct. 29, 2008 and SE 0802286-5 which was filed on Oct. 27, 2008, the entirety of which is incorporated by reference herein.

BACKGROUND

1. Field

The present embodiments generally relate to ballast systems for a marine structure. The ballast system comprises a ballast tank and a pump. The pump comprises a low side and a high side and the ballast system comprises a first inlet conduit assembly adapted to provide a fluid communication between the ballast tank and the low side. The ballast system is adapted to provide a first operating condition in which first operating condition a fluid is pumped from the low side to the high side.

2. Description of the Related Art

A marine structure, such as a ship or a semi-submersible unit, is often provided with one or more ballast systems in order to control the draught and/or the inclination of the marine structure. Generally, a ballast system comprises a ballast tank, and in fact often a plurality of tanks, which is adapted to be filled with sea water—i.e. water ambient of the marine structure—through a water filling assembly.

In order to be able to empty the ballast tank, the ballast system further generally comprises a pump assembly which in turn comprises a pump and means for fluidly connecting the tank and the pump as well as means for connecting the pump and the environment ambient of the marine structure such that water may be pumped from the tank to the ambient environment. Generally, at least a portion of the pump assembly is in fluid communication with the aforesaid water filling assembly.

However, when a ballast tank is filled with water, there is a risk that air will be mixed with the water such that air will be entrained in the water filling assembly and—at a later stage—in at least a portion of the pump assembly. As such, when a ballast tank is to be emptied of water, there is a risk that the air in the pump assembly will be guided towards the pump and hence introduced in the pump. Since air generally adversely effects a pump, the presence of air is undesired.

Moreover, at the completion of a ballast tank emptying operation, i.e. when a ballast tank is almost completely emptied of water, the water flow from the ballast tank to the pump is generally lower than in the beginning of the ballast tank emptying operation. Since a pump generally has an optimum operating condition at a specific combination of the flow rate and pressure, the aforesaid change in the water flow is generally undesired.

Additionally, during load altering operations of the marine structure, such as multiple ballast operations and/or oil refuelling, which occur simultaneously as a ballast tank emptying operation, there may be a need for controlling the rate at which the ballast tank is emptied in order to maintain a balance in the marine structure. Moreover, when a ballast tank is almost emptied of water, it may be desirable to have a low flow rate of the water leaving the ballast tank in order to at least limit the amount of air in the water entering the pump.

In view, of the above, a need for improvements in the field of ballast systems exists.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
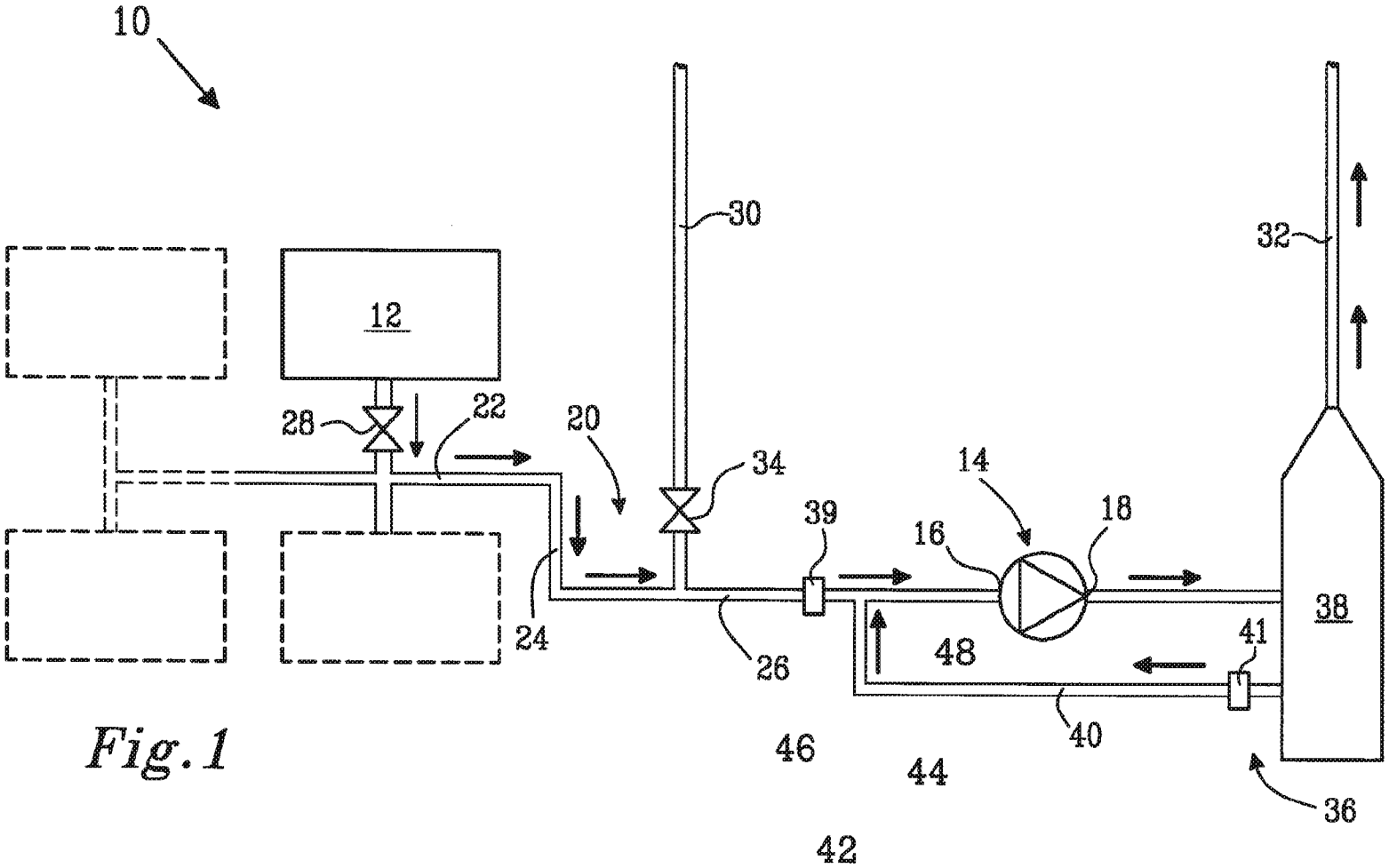
FIG. 1 illustrates a schematic side view of a ballast system of the present invention.

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

A first object of the invention is to overcome or ameliorate at least one of the disadvantages of the prior art, or to provide a feasible alternative.

A second object of the present invention is to provide a pump assembly, wherein adverse effects on the pump due to air mixed in the liquid pumped by the pump is reduced.

A third object of the present invention is to provide a pump assembly, which provides for that the pump of the pump assembly may operate at flows and pressures which are close to the flow and the pressure of the optimum operating condition of the pump even when the flow and/or pressure of the liquid fed to the pump may vary.

At least one of the objects above may be achieved by a ballast system according to claim 1.

As such, the present invention relates to a ballast system for a marine structure. The ballast system comprises a ballast tank and a pump which pump comprises a low side and a high side and the ballast system comprises a first inlet conduit assembly adapted to provide a fluid communication between the ballast tank and the low side. The ballast system is adapted to provide a first operating condition in which first operating condition a fluid is pumped from the low side to the high side.

According to the invention, the ballast system further comprises a recirculation conduit assembly adapted to provide a fluid transport from the high side to the low side during at least a part of the first operating condition.

By a ballast system according to claim 1, water which is pumped through the pump during for instance a ballast tank emptying operation may be recirculated in the recirculation conduit such that an increase water flow is obtained through the pump. This recirculation may provide for that the pump operates at an operating condition which is close to the optimum one for the pump even if the flow from the ballast tank per se is lower than the optimum flow for the pump.

Moreover, the recirculation may provide for that air, for instance in the form of air bubbles, possibly approaching the low side of the pump will be disintegrated into appropriately small bubbles before entering the low side. Moreover, the recirculated liquid may compress the air such that the volume of the air in the liquid is reduced before entering the pump.

As used herein, the expression "pump" relates to any type of device being adapted to move a fluid (i.e. liquid and/or gas) such that a higher pressure of the fluid is obtained. Moreover, the position of the pump wherein the fluid enters the pump is herein referred to as the "low side" whereas the position of the pump wherein the higher pressure fluid leaves the pump is herein referred to as the "high side".

According to a preferred embodiment of the present invention, the recirculation conduit assembly comprises a separator, preferably a cyclone separator.

The provision of the separator results in that the liquid—which liquid generally is sea water—which is recirculated to the low side has a low, preferably close to zero, air content.

According to another embodiment of the present invention, the recirculation conduit assembly comprises an ejector which in turn comprises a motive fluid inlet, an entrained suction fluid inlet and an ejector outlet. The recirculation conduit assembly is adapted to provide a fluid communication between the high side and the motive fluid inlet during at least a part of the first operating condition.

The ejector will contribute to disintegrating and/or compressing the air even more which hence will provide for that more air may be pumped through the pump.

As used herein, the expression "ejector" relates to a device which uses the pressure energy of a motive fluid to draw in and possibly compress a suction fluid as well as outputting a mix of the motive and suction fluids.

According to a further embodiment of the present invention, the ballast system is adapted to provide a fluid communication between the first inlet conduit assembly and the entrained suction fluid inlet during at least a part of the first operating condition.

According to another embodiment of the present invention, the ballast system is adapted to provide a fluid communication between the ejector outlet and the low side during at least a part of the first operating condition.

According to a further embodiment of the present invention, the ballast system further comprises a second inlet conduit assembly, wherein the ballast system is adapted to provide a fluid communication between the second inlet conduit assembly and the low side during at least a part of the first operating condition.

The possibility of providing a second inlet conduit assembly is at least partially enabled due to the fact that the ballast system of the present invention comprises a recirculation conduit. As such, even though the second inlet conduit assembly is adapted to be connected to an auxiliary system—such as a bilge water system—of the marine structure which generally provides lower liquid flows than the ballast system, this difference in flows may be compensated by the recirculation conduit.

According to another embodiment of the present invention, the ballast system is adapted to provide a fluid communication between the second inlet conduit assembly and the entrained suction fluid inlet.

According to another embodiment of the present invention, the ballast system further comprises a coupling arrangement comprising an inner conduit and an outer conduit wherein both the inner conduit and the outer conduit are in fluid communication with the low side, the outer conduit substantially enclosing the inner conduit, the first inlet conduit assembly being in fluid communication with the outer conduit and the ejector outlet being in fluid communication with the inner conduit.

According to a further embodiment of the present invention, the inner conduit has an inner conduit inlet and an inner conduit outlet, wherein the outer conduit comprises a tapered portion at the location of the inner conduit outlet.

According to another embodiment of the present invention, the first inlet conduit assembly comprises an inlet separator, the inlet separator being adapted to be in fluid communication with the ballast tank as well as the low side.

The inlet separator provides the possibility of removing air from the first inlet conduit assembly, which removal may further reduce the effects of air mixed in the water of the pump assembly.

According to a further embodiment of the present invention, the ballast system further comprises an outlet conduit assembly which is adapted to be in fluid communication with the inlet separator. The aforesaid outlet conduit may preferably be used for removing air from the inlet separator.

According to another embodiment of the present invention, the outlet conduit assembly further comprises a priming ejector comprising a priming ejector motive fluid inlet, a priming ejector entrained suction fluid inlet and a priming ejector outlet, the priming ejector entrained suction fluid inlet being adapted to be in fluid communication with the inlet separator.

With an arrangement according to the above, the liquid recirculated in the recirculation conduit assembly may be used for emptying the inlet separator of air. This is advantageous, since no additional drive means, such as an additional pump, is needed for the reduction of air in the ballast system.

According to a further embodiment of the present invention, the priming ejector motive fluid inlet is adapted to be in fluid communication with the high side.

According to another embodiment of the present invention, the ballast system further comprises a restoring conduit assembly comprising a restoring separator and a liquid seal, wherein the liquid seal is in fluid communication with the inlet separator and the restoring separator, the priming ejector outlet being in fluid communication with the restoring separator.

According to a further embodiment of the present invention, the ballast system further comprises a cutoff conduit assembly providing a fluid communication between the liquid seal and the outlet conduit assembly.

According to another embodiment of the present invention, the restoring conduit further comprises an outlet conduit providing a fluid communication between the separator and the environment ambient of the ballast system.

According to a further embodiment of the present invention, at least a portion of the first inlet conduit is located at a first elevation, the low side being located at an elevation below the first elevation.

A second aspect of the present invention relates to a marine structure comprising a ballast system according the first aspect of the present invention.

A third aspect of the present invention relates to a method for transporting fluid from a ballast tank of a ballast system to the environment ambient of the ballast system, the ballast system further comprising a pump which in turn comprises a low side and a high side, the method comprising the steps of providing a fluid communication between the ballast tank and the low side; providing a fluid communication between the high side and the ambient environment; and providing that the pump is in an operating condition such that fluid is pumped from the low side to the high side.

According to the third aspect of the present invention, the method further comprises the steps of determining a quality measure indicative of at least one property of the fluid transported from the ballast tank to the low side; comparing the quality measure with a predetermined interval; and if the quality measure falls within the predetermined interval, conveying at least a portion of the fluid at the high side back to the low side when the pump is in the operating condition.

As used herein, the expression "interval" encompasses both bounded (for instance [a, b] or (a, b)) as well as half bounded (such as $(-\infty, b]$ or $[a, \infty)$) intervals. As such, an example of an interval which falls within the above definition may be an interval which includes every value below a predetermined threshold value.

Moreover, an embodiment of the method according to the third aspect of the present invention may comprise the steps of comparing the quality measure with a plurality of predetermined intervals.

According to a preferred embodiment of the third aspect of the present invention, the quality measure is indicative of the amount of gas—such as air—in the fluid and/or the flow rate of the fluid approaching the low side.

According to a preferred embodiment of the third aspect of the present invention, the ballast system comprises an inlet separator being adapted to be in fluid communication with the ballast tank as well as the low side, wherein the step of determining the quality measure comprises a step of determining the amount of gas in the inlet separator.

A fourth aspect of the present invention relates to a computer program product comprising a computer program containing computer program code executable in a computer or a processor to implement steps of a method of the third aspect of the present invention. A fifth aspect of the present invention relates to an electronic control unit comprising such a computer program product.

With reference to the figures, FIG. 1 illustrates a schematic side view of a ballast system 10 of the present invention. The ballast system 10 is preferably used in a marine structure (not shown), such as a ship or any other floating unit. Purely by way of example, the ballast system 10 may preferably be used in a semi-submersible vessel, i.e. a vessel having a deck and a float and one or more supporting columns connecting the deck and the float to one another. A marine structure may be provided with a plurality of ballast systems 10 and, in particular, a semi-submersible unit is generally provided with one ballast system 10 per supporting column (not shown).

As may be gleaned from FIG. 1, the ballast system 10 of the present invention comprises a ballast tank 12. Generally, a ballast system 10 comprises a plurality of ballast tanks as indicated by the dotted lines in FIG. 1. Moreover, the ballast system 10 comprises a pump 14 comprising a low side 16 and a high side 18. Preferably, the ballast system 10 of the present invention comprises at least two pumps. The pump 14 may be any means for moving a liquid but preferably a rotodynamic pump, such as a centrifugal pump, is used in the ballast system 10.

The ballast system 10 also comprises a first inlet conduit assembly 20 adapted to provide a fluid communication between the ballast tank 12 and the low side 16 of the pump 14. In FIG. 1, the first inlet conduit assembly 20 includes a plurality of pipes 22, 24, 26 which are connected to one another so as to form the first inlet conduit assembly 20 although one continuous pipe may be used as a first inlet conduit assembly. Moreover, the first inlet conduit assembly 20 preferably comprises a valve 28 for controlling the liquid flow in and/or out of the ballast tank 12.

Furthermore, the ballast system 10 generally comprises a liquid supply assembly 30 and a liquid discharge assembly 32 wherein the liquid supply assembly 30 may be connected to the first inlet conduit assembly 20, preferably through a valve 34, whereas the liquid discharge assembly 32 generally is in fluid communication with the high side 18 of the pump 14. Generally, the liquid used in the ballast system 10 is sea water but in some specific applications of the ballast system 10 of the present inventions, other liquids may be used.

FIG. 1 illustrates the ballast system 10 in a first operating condition wherein the ballast tank 12 is emptied of liquid. As such, the direction of flow is indicated by arrows and as may be realized from FIG. 1, the liquid is conducted from the ballast tank 12, through the first inlet conduit assembly 20, the pump 14 and the discharge assembly 32. As such, in the first operating condition the liquid is pumped from the low side 16 to the high side 18 of the pump 14. If the liquid used in the ballast system 10 is sea water, the liquid is generally conducted from the discharge assembly 32 to the water ambient of the ballast system 10, i.e. the water ambient of the marine structure (not shown) in which the ballast system 10 is located.

Preferably, the liquid discharge assembly 32 is adapted to discharge liquid at a level above the tank 12. More preferred, the liquid discharge assembly 32 is adapted to discharge liquid at a level above the operating water line of the marine structure (not shown) such that the risk of having sea water entering the liquid discharge assembly 32 from above is low. Purely by way of example, if the marine structure is a semi-submersible unit (not shown), the liquid discharge assembly 32 may be adapted to discharge liquid at a level which is approximately 10-15 meters above the still water line when the submersible unit is in an operational draught.

FIG. 1 illustrates that the ballast system 10 of the present invention also comprises a recirculation conduit assembly 36 adapted to provide a fluid communication between the high side 18 and the low side 16 of the pump 14 during at least a part of the first operating condition. The recirculation conduit assembly 36 may in its simplest form be a pipe connected to the high side 18 and the low side 16. However, and as is illustrated in FIG. 1, the recirculation conduit assembly 36 preferably comprises a separator 38, preferably a cyclone separator—in fluid communication with the high side 18—in addition to a pipe 40 providing a fluid communication between the separator and the low side 16. The advantage of the presence of the aforementioned separator 38 is that liquid recirculated through the recirculation conduit assembly 36 has a low amount of air.

Although the recirculation conduit assembly 36 in FIG. 1 is illustrated as a separate pipe, the recirculation conduit assembly 36 may be obtained in a plurality of ways. Purely by way of example, if the pump 14 comprises a housing (not shown in FIG. 1) the recirculation conduit assembly 36 may be obtained by arranging one or more channels in the housing providing a fluid communication between the high side 18 and the low side 16.

Moreover, the ballast system 10 of the present invention preferably comprises determining means 39 for determining the flow rate and/or for determining the amount of air mixed in the liquid transported from the ballast tank 12 to the low side 16. Additionally, the recirculation conduit assembly 36 may be provided with control arrangements 41 such as one or more valves, for controlling the flow rate through the recirculation conduit assembly 36. The positions of the determining means 39 and the control arrangements 41 in FIG. 1 in relation to the ballast system 10 is only exemplifying and in other embodiments of the ballast system 10 of the present invention, the aforesaid positions may be different.

As such, if it is realized—during the first operating condition illustrated in FIG. 1—that the flow rate of the liquid entering the low side 16 is within a predetermined interval, e.g. below a predetermined desired value, liquid may be recirculated through the recirculation conduit assembly 36 in order to increase the flow rate to thereby obtain a more preferred flow for the pump 14. Optionally, or in addition, if it is realized that the amount of air in the liquid entering the low side 16 is above a predetermined threshold value, recirculation may also be employed in order to disintegrate the air into small bubbles and/or to compress the air. To this end, the recirculation conduit assembly 36 preferably comprises nozzles (not shown) in the vicinity of the low side 16 which nozzles are adapted to disintegrate the air into the liquid.

In the embodiment of the ballast system 10 illustrated in FIG. 1 the liquid distribution arrangement adapted to transport liquid from the ballast tank 12 to the environment ambient of the ballast system 10—and even to the environment ambient of the marine structure—may be regarded as a pump assembly of the ballast system 10. As such, the aforesaid pump assembly—in the embodiment illustrated in FIG. 1—comprises the first inlet conduit assembly 20, the pump 14 and the recirculation conduit assembly 36. The above definition as regards the pump assemblies applies for all of the ballast system 10 embodiments presented hereinbelow.

Moreover, a ballast system 10 of the present invention preferably comprises two pump assemblies—each one of the pump assemblies comprising at least a pump and a corresponding recirculation conduit assembly 36—in order to enhance the reliability of the ballast system 10.

Figure 2:
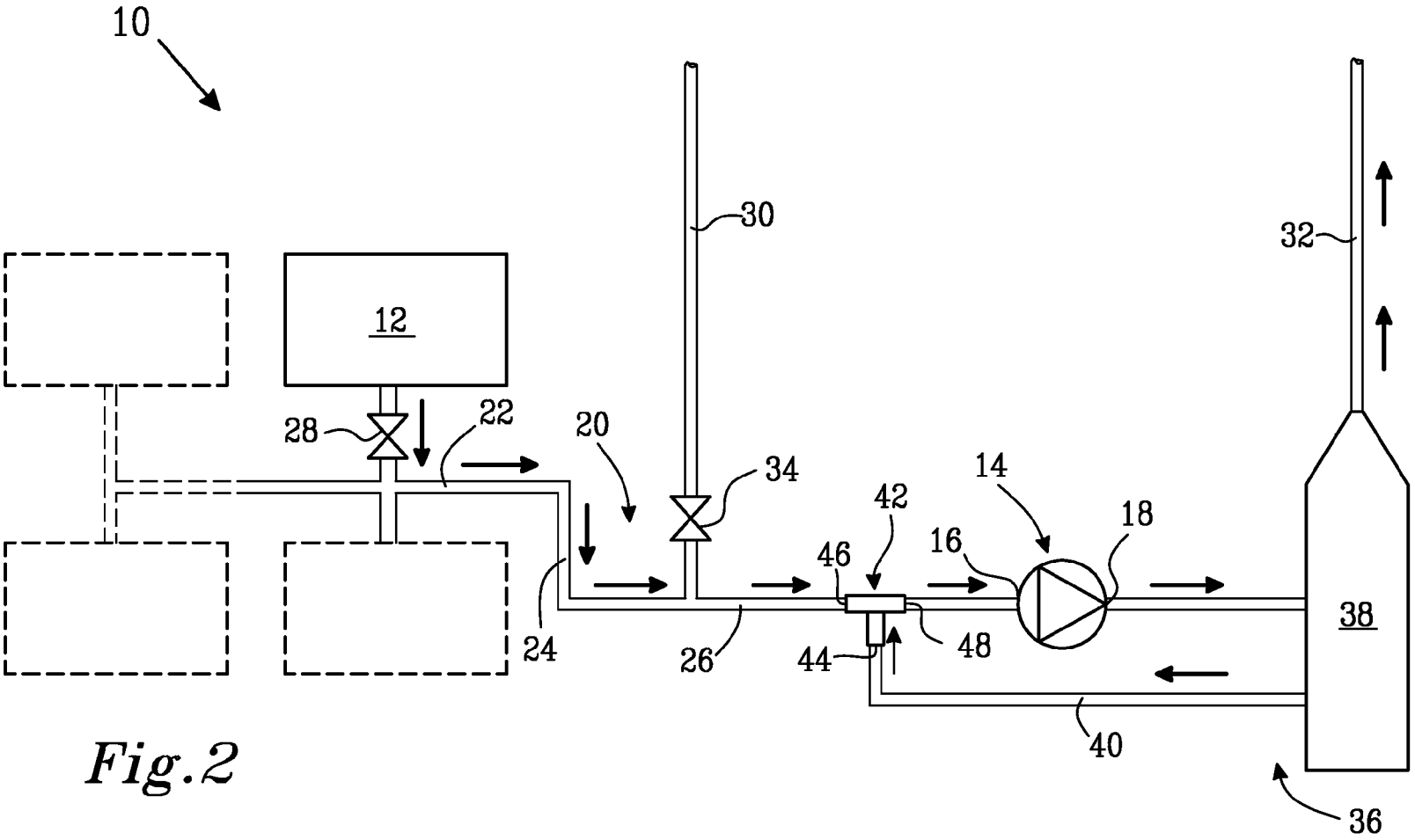
FIG. 2 illustrates a schematic side view of an embodiment of the ballast system of the present invention.

FIG. 2 illustrates another embodiment of the ballast system 10 of the present invention. As may be realized from FIG. 2, instead of the aforementioned nozzles, the recirculation conduit assembly 36 comprises an ejector 42 which in turn comprises a motive fluid inlet 44, an entrained suction fluid inlet 46 and an ejector outlet 48.

As indicated by arrows in FIG. 2, in the operational condition illustrated therein, the recirculation conduit assembly 36 provides a fluid communication between the high side 18 and the motive fluid inlet 44 such that the ejector 42 will be fed by liquid recirculated from the high side 18. As such, if the flow rate in the first inlet conduit assembly 20 is below a desired value, the ejector 42 will provide an increased flow rate prior to the low side. Moreover, the ejector 42 may also compress possible air bubbles in the first inlet conduit assembly 20. To this end, the volume—rather than the mass—of the air occluded in the liquid is a critical parameter as regards the function of the pump 14.

Figure 3A:
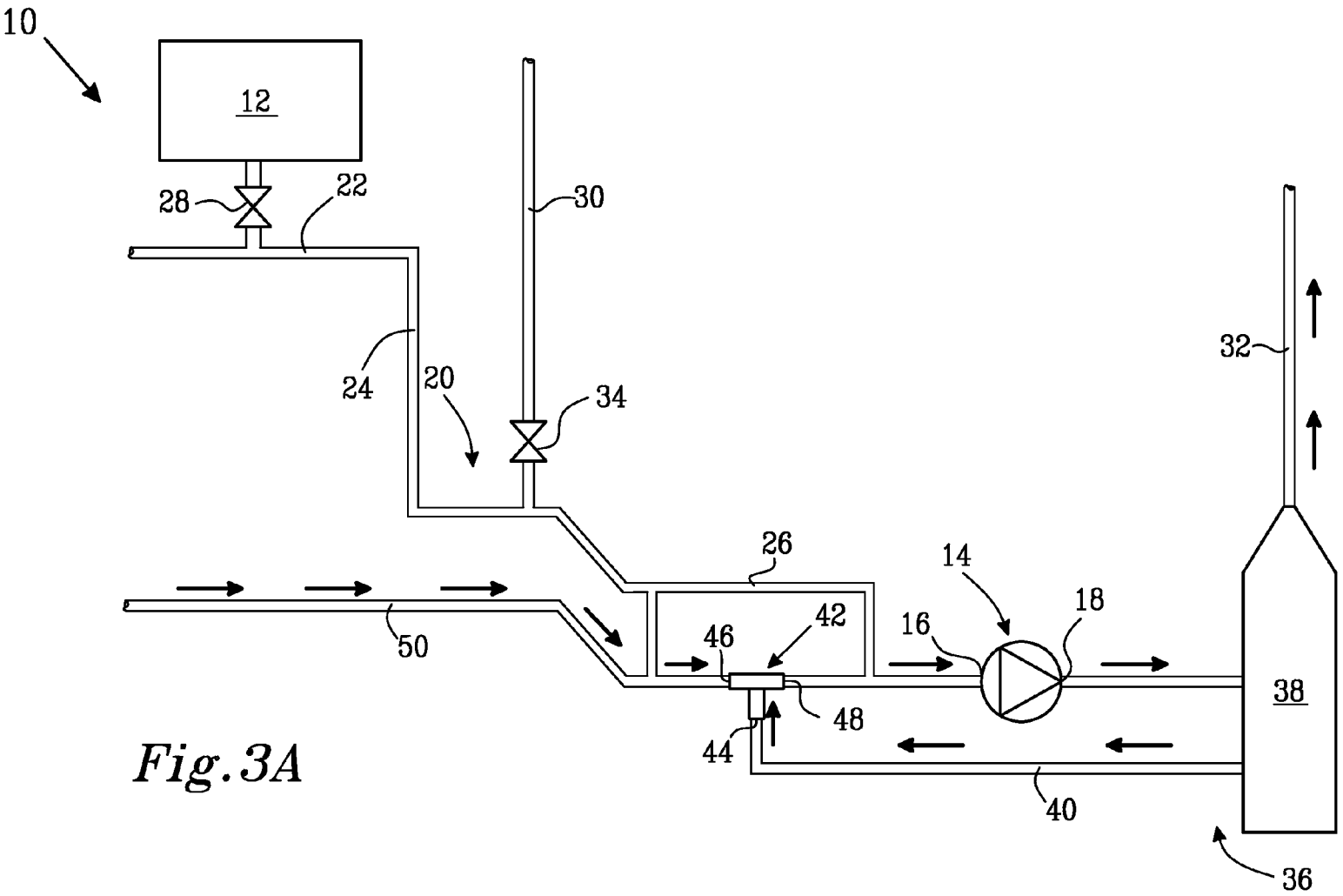
FIG. 3A illustrates a schematic side view of a further embodiment of the ballast system of the present invention when the ballast system is in a second operating condition.

FIG. 3A illustrates a further embodiment of the ballast system 10 of the present invention wherein the ballast system 10 further comprises a second inlet conduit assembly 50 and the ballast system 10 is adapted to provide a fluid communication between the second inlet conduit assembly 50 and the low side 16 during at least a part of the first operating condition.

The second inlet conduit assembly 50 may in turn be connected to any one of a plurality of auxiliary liquid distribution systems (not shown) of the marine structure (not shown) including, but not limited to: a tire water system or a cooling system. However, in a preferred implementation of the FIG. 3A embodiment, the second inlet conduit assembly 50 is connected to a bilge system (not shown) of the marine structure.

Traditionally, the bilge system of a marine structure is connected to an individual bilge pump dedicated to serve the bilge system, which bilge pump generally has a lower capacity than the pump 14 of the ballast system 10. However, with a ballast system 10 as presented in FIG. 3A, the pump 14 of the ballast system 10 may in fact also be used for pumping bilge water from the bilge system and this possibility is at least partially enabled due to the presence of the recirculation conduit assembly 36. As may be gleaned from FIG. 3A, in the embodiment of the ballast system 10 disclosed therein, a fluid communication is provided between the second inlet conduit assembly 50 and the low side 16 during at least a part of a second operating condition at which water is pumped from the bilge system (not shown). The second operating condition is indicated by arrows in FIG. 3A.

Moreover, FIG. 3A teaches that the second inlet conduit assembly 50—in the second operating condition—is in fluid communication with the entrained suction fluid inlet 46 of the ejector 42. As such, liquid pumped from the second inlet conduit assembly 50 will pass the ejector 42 on its way towards the low side 16. The advantages of this passing is inter alia that any air bubbles in the second inlet conduit assembly 50 will be disintegrated and/or compressed when passing through the ejector 42 as wall as that the liquid entering the low side 16 will have an appropriately high flow as regards the capacity of the pump 14.

Figure 3B:
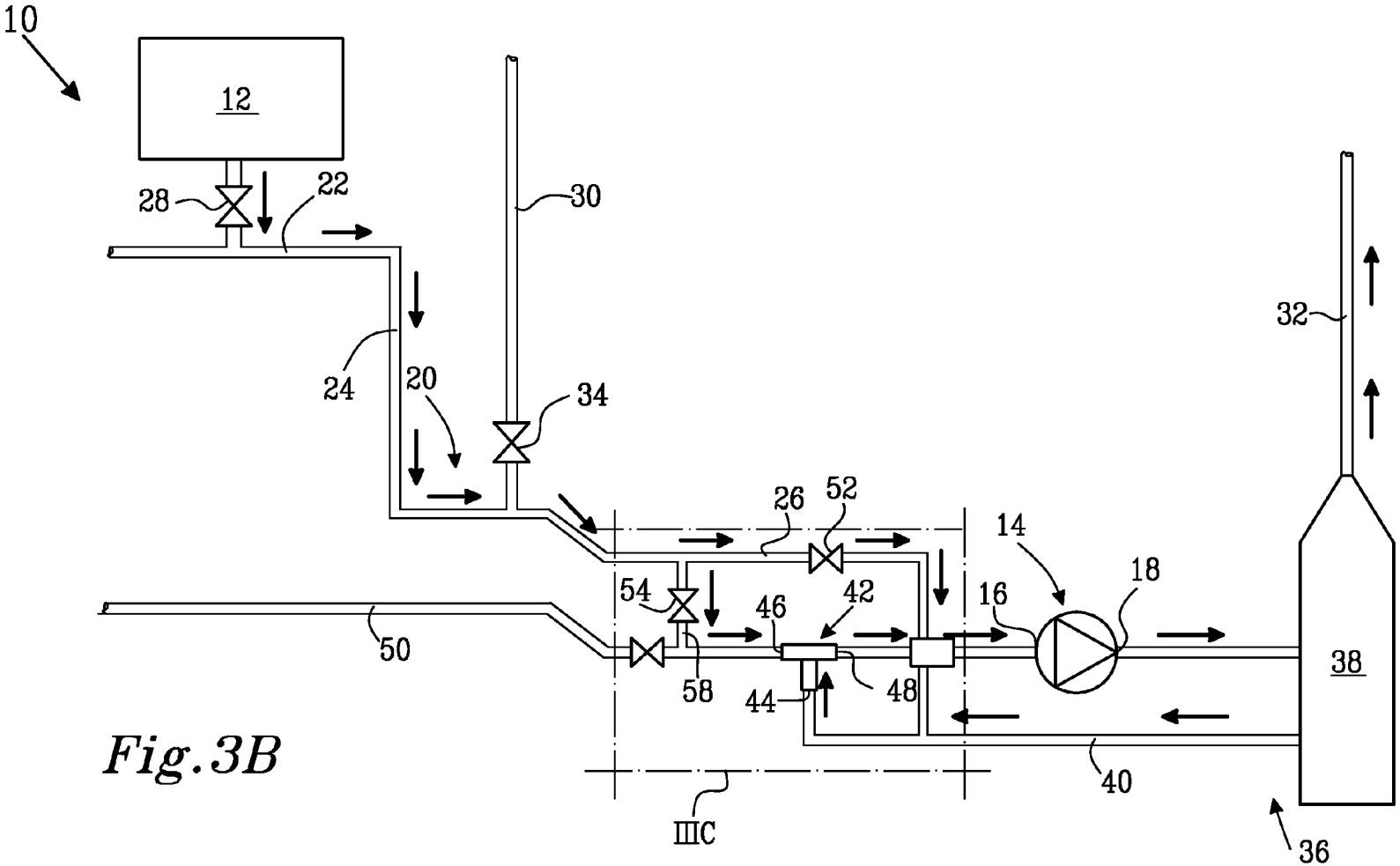
FIG. 3B illustrates a schematic side view of the FIG. 3A embodiment of the ballast system of the present invention when the ballast system is in a first operating condition.

FIG. 3B illustrates the FIG. 3A embodiment when the ballast system 10 is in a first operating condition, i.e. when liquid is pumped from the ballast tank 12. As may be realized from FIG. 3*b*, the ballast system 10 comprises a bypass conduit 58 which is adapted to provide a fluid communication between the first inlet conduit assembly 20 and the entrained suction fluid inlet 46 of the ejector 42. As such, when the FIG. 3B ballast system 10 is in the first operating condition, a bypass valve 54 may—depending on the flow rate in the first inlet conduit assembly 20—be at least partially opened thus providing a fluid communication between the first inlet conduit assembly 20 and the entrained suction fluid inlet 46. At the same time a first inlet valve 52 may be closed or at least partially open. If the first inlet valve 52 is at least partially open, a fluid communication is provided between the first inlet conduit assembly 20 and a coupling arrangement 60 (not shown in FIG. 3B).

Figure 3C:
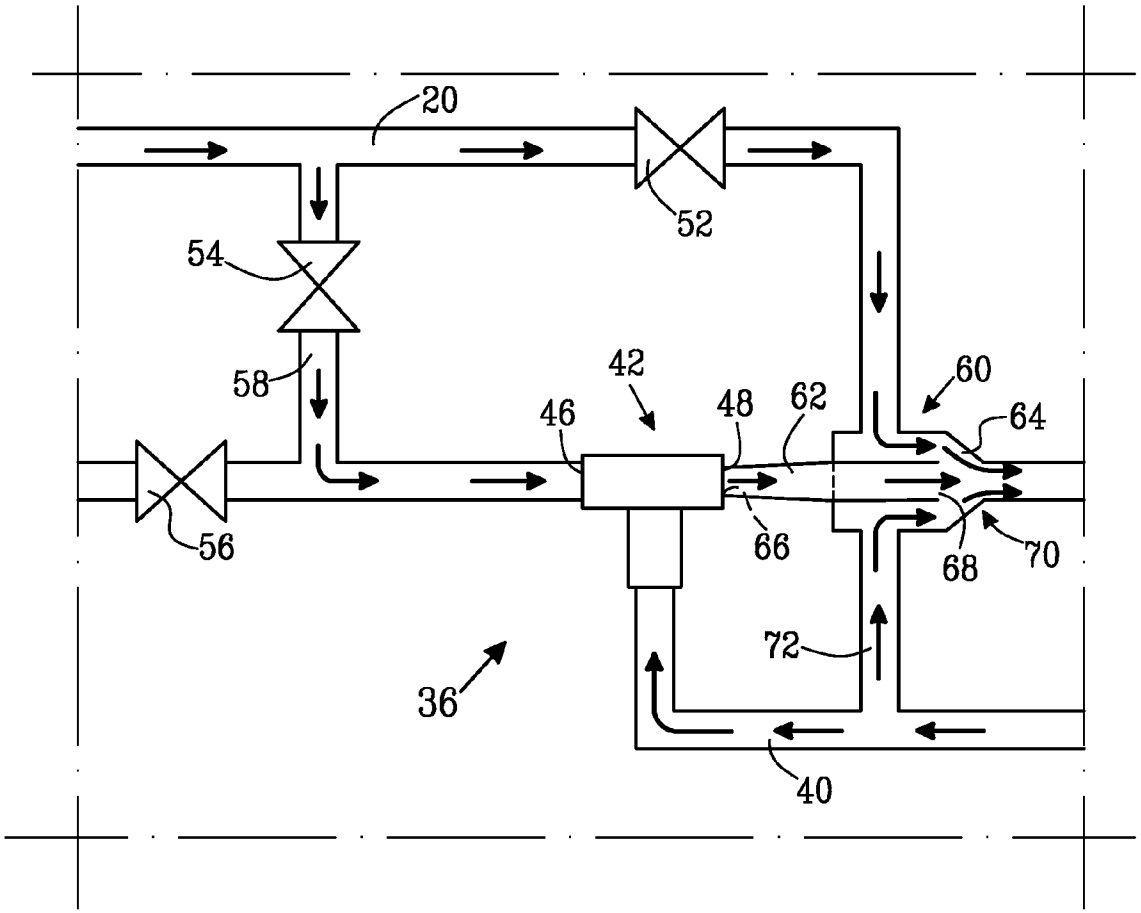
FIG. 3C illustrates an enlargement of a portion of the FIG. 3B embodiment of the ballast system of the present invention.

FIG. 3C illustrates a cross section of the coupling arrangement 60 which arrangement comprises an inner conduit 62 and an outer conduit 64 wherein both the inner conduit 62 and the outer conduit 64 are in fluid communication with the low side 16 of the pump 14. Moreover, FIG. 3C illustrates that the outer conduit 64 substantially encloses the inner conduit 62, and that the ejector outlet 48 is in fluid communication with the inner conduit 62. As may be gleaned from FIG. 3C, the inner conduit has an inner conduit inlet 66 and an inner conduit outlet 68, wherein the outer conduit 64 comprises a tapered portion 70 at the location of the inner conduit outlet 68. The tapered portion 70 of the outer conduit 64 will ensure that liquid transported through the inner conduit 62 and/or the outer conduit 64 will assume a preferred direction of flow—i.e. a substantially parallel to a direction from the inner conduit inlet 66 to the inner conduit outlet 68—prior to entering the low side 16.

FIG. 3C also teaches that the recirculation conduit assembly 36 may comprise a recirculation bypass conduit 72 adapted to provide a fluid communication between the high side and the outer conduit 64 without passing the ejector 42.

The coupling arrangement 60, as well as the pump 14 and at least a portion of the recirculation conduit assembly 36, of the FIG. 3A to 3C ballast system 10 preferably are located below the first and second inlet conduit assemblies 20, 50. In other words, at least a portion of the first inlet conduit 20 is located at a first elevation, at least a portion of the second inlet conduit 50 is located at a second elevation and the low side 16 is located at a third elevation which third elevation is below the first and second elevations. This preferred location of the coupling arrangement 60, the pump 14 and possibly also the recirculation conduit assembly 36 provides for that at least the coupling arrangement 60 is filled with liquid when the pump 14 is actuated. As such, the risk of starting the pump 14 in a condition wherein the coupling arrangement 60 is at least partially filled with air is at least substantially reduced.

Moreover, the ballast system 10 of the present invention could be adapted to provide a liquid distribution at a low flow rate from a liquid source—such as the liquid supply assembly 30—to the pump 14. Such a liquid distribution may for instance be used prior to starting the pump 14 in order to ensure that at least the portion of the ballast system 10 which is located in the vicinity of the low side 16 is filled with water prior to starting the pump 14 (i.e. in order to perform an initial priming of the pump 14). Instead of, or in combination with, the aforesaid initial priming, the liquid distribution from the supply assembly 30 to the pump 14 may be performed for cooling purposes, i.e. to provide additional liquid to the pump 14 in order to ensure that the liquid circulated in the recirculation conduit assembly 36 has a temperature which is below a predetermined value. To this end, the previously discussed determining means (not shown in FIG. 3C) may comprise means for determining the temperature in the recirculation conduit assembly 36 and/or the liquid entering the low side 16.

In some implementations of the FIG. 3B embodiment, the second inlet conduit assembly 50 may be omitted such that substantially only a portion of the liquid conducted through the first inlet conduit assembly 20 is adapted to enter the entrained suction fluid inlet 46.

Figure 4:
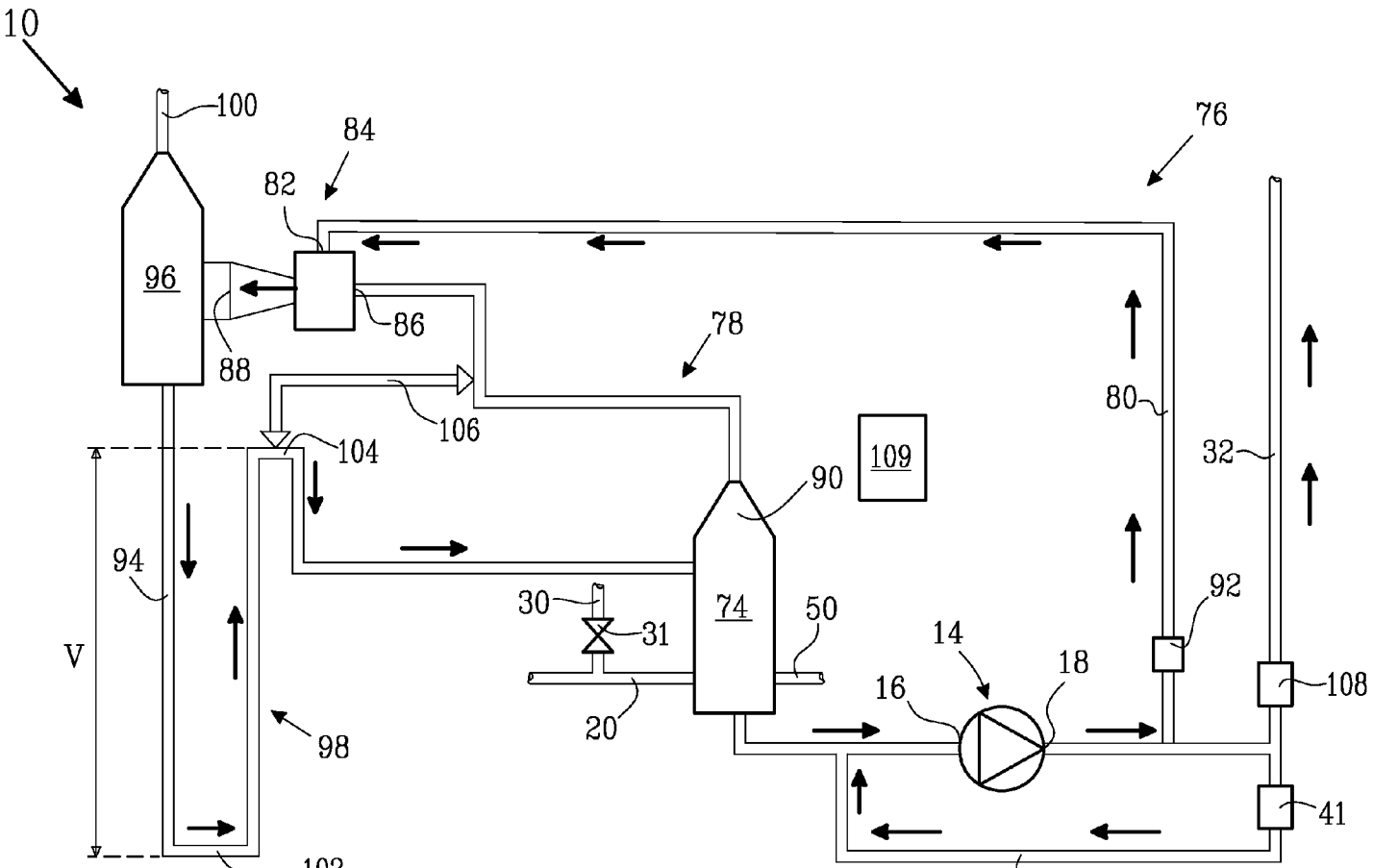
FIG. 4 illustrates a schematic side view of an additional embodiment of the ballast system of the present invention.

FIG. 4 illustrates a side view of an additional embodiment of the ballast system 10 of the present invention. As may be gleaned from FIG. 4, first inlet conduit assembly 20 of the ballast system 10 illustrated therein comprises an inlet separator 74. As for the previous embodiments, the first inlet conduit assembly 20 is adapted to be in fluid communication with at least one ballast tank (not shown) of the ballast system 10. Moreover, the inlet separator 74 is in fluid communication with the low side 16 of the pump 14. Furthermore, a second inlet conduit assembly 50 is in fluid communication with the inlet separator 74. In the embodiment of the ballast system 10 illustrated in FIG. 4, the second inlet conduit assembly 50 is connected to a bilge system (not shown) of the marine structure (not shown). However, in other embodiments of the ballast system 10 of the present invention, the second inlet conduit assembly 50 may be omitted such that only one inlet conduit assembly, namely the first inlet conduit assembly 20, is in fluid communication with the inlet separator 74.

In addition, FIG. 4 illustrates that the ballast system 10 disclosed therein may comprise a recirculation conduit assembly 36 adapted to provide a fluid communication between the high side 18 and the low side 16 of the pump 14. Purely by way of example, the implementation of the FIG. 4 recirculation conduit assembly 36 may be identical to any one of the implementations of the recirculation conduit assemblies 36 as discussed in conjunction with the embodiments of the ballast system 10 discussed hereinabove with reference to any of FIG. 1 to FIG. 3. Moreover, and as is illustrated in the FIG. 4 embodiment of the ballast system 10, the recirculation conduit assembly 36 may be provided without a separator 38 since the inlet separator 74 of the FIG. 4 ballast system 10 generally will provide that the fluid (generally a liquid such as sea water) travelling from the inlet separator 74 to the pump 14 has a low air content. However, in specific embodiments of the FIG. 4 ballast system 10, the recirculation conduit assembly 36 may also be omitted, since the FIG. 4 ballast system 10 in fact already comprises a recirculation conduit assembly 76, as will be discussed more thoroughly hereinbelow.

As may be gleaned from FIG. 4, the ballast system 10 comprises an outlet conduit assembly 78 which is adapted to be in fluid communication with the inlet separator 74. In fact, the outlet conduit assembly may even be adapted to always be in fluid communication with the inlet separator 74. The outlet conduit assembly 78 is preferably connected to the uppermost portion of the inlet separator 74 such that gasses, mostly air, may be extracted from the inlet separator 74.

In order to enhance the extraction of air from the inlet separator 74, the ballast system 10 preferably comprises a motive fluid conduit assembly 80 providing a fluid communication between the high side 18 of the pump 14 and a motive fluid inlet 82 of a priming ejector 84, which priming ejector further comprises a priming ejector entrained suction fluid inlet 86 and a priming ejector outlet 88 wherein the priming ejector entrained suction fluid inlet 86 is connected to the outlet conduit assembly 78 such that a fluid communication is provided between the inlet separator 74 and the entrained suction fluid inlet 86. As such, at least a portion of liquid from the high side 18 of the pump 14 is—at least during certain predetermined operating conditions—transported to the motive fluid inlet 82 such that the liquid will contribute to drawing out the air in the inlet separator 74 through the outlet conduit assembly 78.

An example of a predetermined operating condition wherein liquid is allowed to flow from the high side 18 to the motive fluid inlet 82 may be when an air volume above a predetermined threshold volume is identified in the inlet separator 74. To this end, the ballast system 10 of the present invention may preferably comprise a sensor arrangement 90 adapted to determine the volume of the air enclosed in the inlet separator 74. Such a sensor arrangement 90 may preferably be in communication with a motive fluid control arrangement 92—indicated by a single valve 92 in FIG. 4—controlling the amount of liquid flow through the motive fluid conduit assembly 80.

When liquid flows in the motive fluid conduit assembly 80 so as to feed the priming ejector 84, a mixture of air and liquid will leave the priming ejector 84 through the priming ejector outlet 88 which in turn is in fluid communication with a restoring conduit assembly 94 which in the FIG. 4 embodiment comprises a restoring separator 96 and a liquid seal 98. As may be realized from FIG. 4, the priming ejector outlet 88 may preferably discharge into the restoring separator 96. The restoring separator 96 further comprises an air discharge conduit 100 such that air in the restoring separator 96 may leave the ballast system 10 of the present invention.

The liquid seal 98 preferably comprises a conduit—or a plurality of conduits joined together so as to form a continuous conduit arrangement—which in turn comprises a lower bend 102 and an upper bend 104 wherein the first and second bend are distanced from one another by a vertical distance V, which vertical distance preferably is more than 10 meters, more preferably more than 11 meters.

As may be realized when studying the FIG. 4 embodiment, the motive fluid conduit assembly 80, the restoring conduit assembly 94, the inlet separator 74 and portions of the first inlet conduit assembly 20 together form a motive fluid recirculation conduit assembly 76 for the ballast water system 10, which motive fluid recirculation conduit assembly 76 provides a fluid communication between the high side 18 and the low side 16 to thereby enable liquid transport from the high side 18 to the low side 16. The motive fluid recirculation conduit assembly 76 just described may in some embodiments of the present invention be the only recirculation conduit assembly of the ballast system 10 adapted to provide a fluid passage from the high side 18 to the low side 16. However, and as been previously discussed, other embodiments of the ballast system 10 of the present invention may also comprise an additional recirculation conduit assembly 36 such as any one of the recirculation conduit assemblies 36 presented in the FIG. 1 to FIG. 3 embodiments.

FIG. 4 ballast system 10 also comprises a cut-off conduit assembly 106 providing a fluid communication between the liquid seal 98—preferably at the location of the upper bend 104—and the outlet conduit assembly 78 in order to reduce the risk of having the liquid seal 98 emptied of liquid due to inter alia a siphon action.

As may be gleaned from FIG. 4, the ballast system 10 illustrated therein also comprises a recirculation conduit control arrangement 41—such as one or more valves—adapted to control the flow rate through the recirculation conduit assembly 36. Moreover, the FIG. 4 ballast system 10 comprises a discharge control arrangement 108 adapted to control the flow rate through the discharge assembly 32.

The motive fluid control arrangement 92, the recirculation conduit control arrangement 41 and the discharge control arrangement 108 may preferably be operated individually and/or in combination in order to ensure that the amount of gas, such as air in the inlet separator 74—and consequently in the fluid approaching the pump 14—is kept appropriately low. To this end, a control method is preferably used the steps of which are briefly discussed hereinbelow with reference to the FIG. 4 ballast system 10 as well as the flow chart illustrated in FIG. 5.

In the aforesaid control method, the amount of air in the inlet separator 74 is determined, preferably by using the sensor arrangement 90 or any other suitable means for determining the air content in the inlet separator 74. The thus determined amount of air Ac in the inlet separator 74 is then compared to a plurality of predetermined threshold values T1, T2, T3 and T4.

If the amount of air Ac in the inlet separator 74 is below a first threshold value T1, the motive fluid control arrangement 92 and the recirculation conduit control arrangement 41 are closed whereas the discharge control arrangement 108 is in a position so as to allow a maximum flow through the discharge assembly 32. Thus, the ballast system 10 is then a condition wherein fluid transport through the motive fluid recirculation conduit assembly 76 as well as the recirculation conduit assembly 36 is prevented in order to ensure that a high flow rate is obtained from the first inlet conduit assembly 20 to the discharge assembly 32.

However, if the amount of air Ac in the inlet separator 74 is equal to or above the first threshold value T1, the motive fluid control arrangement 92 is operated to an at least partially opened condition such that fluid transport through the motive fluid recirculation conduit assembly 76 is enabled. This is indicated in boxes 112 and 114 in FIG. 5. As such, the motive fluid inlet 82 of the priming ejector 84 is fed with fluid—often liquid such as water—resulting in that the priming ejector 84 will extract air from the inlet separator 74. Moreover, when opening the motive fluid control arrangement 92, the flow rate from the first inlet conduit assembly 20 to the inlet separator 74 is reduced. This reduction of the flow rate is preferred, since an air amount Ac above the first threshold value T1 is indicative of that the air content of the fluid in the first inlet conduit assembly 20 is high. Thus, a reduction of the flow rate from the first inlet conduit assembly 20 to the inlet separator 74 is desired in order to be able to extract the air from the inlet separator 74 in an appropriate manner. Moreover, the reduction of the flow rate in the first inlet conduit assembly 20—when using the above step—may be obtained without obtaining a corresponding reduction of the flow rate towards the low side 16 of the pump 14. Instead, due to the recirculation of fluid through the motive fluid recirculation conduit assembly 76, a constant flow rate—preferably a flow rate close to the optimum operating condition of the pump 14—may be maintained.

Moreover, if the amount of air Ac in the inlet separator 74 is equal to or above a second threshold value T2—which second threshold value 12 is greater than the first threshold value T1—the recirculation conduit control arrangement 41 is operated to an at least partially opened condition such that fluid transport through the recirculation conduit assembly 36 is enabled. This is indicated in boxes 116 and 118 in FIG. 5. As such, a recirculation of fluid is obtained from the high side 18 to the low side 16 resulting in a further reduction of the flow rate from the first inlet conduit assembly 20 to the inlet separator 74. As for the step above corresponding to boxes 112 and 114, the opening of the recirculation conduit control arrangement 41 may provide for that the reduction of the flow rate from the first inlet conduit assembly to the inlet separator 74 is reduced without obtaining a reduction of the flow rate to the low side 16. In certain embodiments of the control method, the steps corresponding to boxes 116 and 118 may be omitted.

Additionally, if the amount of air Ac in the inlet separator 74 is equal to or above a third threshold value T3—which third threshold value T3 is greater than the second threshold value T2—the discharge control arrangement 108 is operated to throttle the discharge assembly 32 such that a reduced flow rate is obtained in the discharge assembly 32. This is indicated in boxes 120 and 122 in FIG. 5. This reduction of flow rate in the discharge assembly 32 further reduces the flow rate from the first inlet conduit assembly 20 to the inlet separator 74. The reduction of the flow rate in the discharge assembly 32 will generally result in a corresponding reduction of the flow rate towards the low side 16. However, due to the recirculation in the motive fluid recirculation conduit assembly 76 and the recirculation conduit assembly 36, the flow rate towards the low side 16 may nevertheless be maintained within a preferred flow rate interval for the pump 14. The discharge control arrangement 108 is preferably adapted to perform a continuous—i.e. stepless—throttling of the discharge assembly 32. As such, the steps of the control method indicated in boxes 120 and 122 in FIG. 5 may comprise a step of determining how much the amount of air Ac in the inlet separator 74 exceeds—i.e. not just that it actually is equal to or above—the third threshold value T3. Depending on the information as regards how much the amount of air Ac exceeds the third threshold value T3, the discharge control arrangement 108 is operated to a throttle percentage corresponding to a function of the difference Ac−T3. In certain embodiments of the control method, the steps corresponding to boxes 120 and 122 may be omitted, for instance if it not desired to throttle the discharge assembly 32.

Finally, if the amount of air Ac in the inlet separator 74 is equal to or above a fourth threshold value T4—which fourth threshold value T4 is greater than the third threshold value T3—the discharge control arrangement 108 is operated to a closed condition such that a flow to the discharge assembly 32 is prevented. This is indicated in boxes 124 and 126 in FIG. 5. This prevention of flow to discharge assembly 32 even further reduces the flow rate from the first inlet conduit assembly 20 to the inlet separator 74. Since the flow rate in the discharge assembly 32 in this case is substantially zero, the flow rate towards the low side 16 in the present condition generally corresponds to the sum of the flow rates through the motive fluid recirculation conduit assembly 76 and the recirculation conduit assembly 36. However, the conduit assemblies are preferably designed so as to allow flow rates of appropriate magnitudes such that the flow rate towards the low side 16 may nevertheless be maintained within a preferred flow rate interval for the pump 14. Purely by way of example, the motive fluid recirculation conduit assembly 76 and the recirculation conduit assembly 36 may be designed so that they together provide a flow rate which is within the range of 50%-70%, preferably 60%-65%, of the preferred flow rate of the pump 14. In certain embodiments of the control method, the steps corresponding to boxes 124 and 126 may be omitted, for instance if it is not desired to close the discharge assembly 32.

The steps of the control method discussed hereinabove with reference to FIG. 4 and FIG. 5 may preferably be repeated, either continuously, periodically at a predetermined frequency (e.g. every 30 seconds) or by the actuation of an operator.

Figure 5:
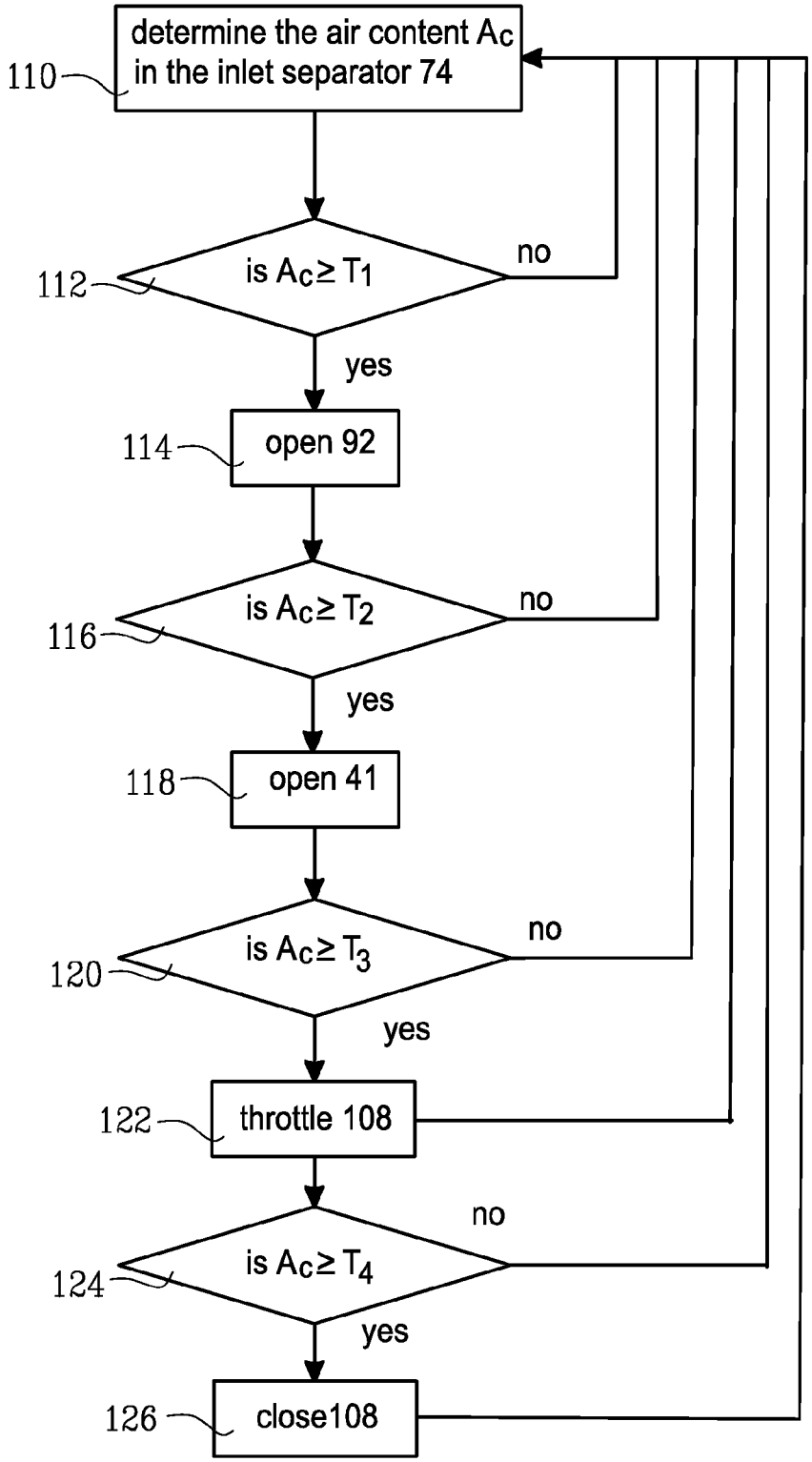
FIG. 5 illustrates a flow chart illustrating steps of a preferred method of the third aspect of the present invention.

Further, in certain implementations of the control method, the steps may be performed in a reversed order as compared to the FIG. 5 flow chart. Moreover, implementations of the above described control method may comprise additional control steps. Purely by way of example, if it is determined that the amount of air Ac in the inlet separator 74 is equal to or above a third threshold value T3 and the discharge assembly 32 is throttled (c.f. boxes 120 and 122 in FIG. 5) certain implementations of the control method may comprise the steps of continuously or at a predetermined frequency determining the amount of air Ac in the inlet separator 74 and—if needed—re-adjusting the throttling of the discharge assembly 32. Additionally, the control method may preferably comprise a step of closing the motive fluid control arrangement 92 as well as the recirculation conduit control arrangement 41 and operating the discharge control arrangement 108 so as to allow a maximum flow through the discharge assembly 32 prior to executing the steps in FIG. 5.

As such, the just described control method may provide for that the air content of the fluid entering the low side 16 of the pump 14 is kept below a predetermined desired value and at the same time provide for that the flow rate towards the low side 16 is kept close to a desired flow rate or at least within a desired flow rate interval.

Moreover, any one of the steps of the control method presented hereinabove may be performed manually. However, more preferred, all of the above steps are performed by a control unit 109 which preferably comprises an electronic control unit (ECU) with a computer program product adapted to implement the above steps of the control method. As such, the control unit 109 is preferably adapted to communicate with at least the arrangement 90, the motive fluid control arrangement 92, recirculation conduit control arrangement 41 and the discharge control arrangement 108. Also, a control method which does not involve the steps corresponding to boxes 116 and 118 may be used in a ballast system 10 which does not comprise a recirculation conduit assembly 36.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A ballast system for a marine structure, comprising:

a ballast tank;

a pump comprising a pump inlet and a pump outlet, wherein the ballast system provides a first operating condition, in which the first operating condition is a fluid pumped from the pump inlet to the pump outlet, a first inlet conduit assembly in fluid communication between the ballast tank and the pump inlet, a recirculation conduit assembly in fluid communication with the pump inlet and the pump outlet, wherein the recirculation conduit transfers the fluid from the pump outlet to the pump inlet to reduce an air concentration of the fluid at the pump inlet when the air concentration of the fluid at the pump inlet is above a predetermined value, a second inlet conduit assembly in fluid communication with an auxiliary system, a cyclone separator coupled to the recirculation conduit assembly, wherein the ballast system provides fluid communication between the second inlet conduit assembly and the pump inlet during the first operating condition.

2. The ballast system according to claim 1, wherein the recirculation conduit assembly comprises an ejector, wherein the ejector comprises a motive fluid inlet, an entrained suction fluid inlet and an ejector outlet, wherein the recirculation conduit assembly provides fluid communication between the pump outlet and the motive fluid inlet during the first operating condition.

3. The ballast system according to claim 2, wherein the ballast system provides fluid communication between the first inlet conduit assembly and the entrained suction fluid inlet during the first operating condition.

4. The ballast system according to claim 2, wherein the ballast system provides fluid communication between the ejector outlet and the pump the inlet during the first operating condition.

5. The ballast system according to claim 2, wherein the ballast system provides fluid communication between the second inlet conduit assembly and the entrained suction fluid inlet.

6. The ballast system according to claim 2, wherein the ballast system further comprises a coupling arrangement comprising an inner conduit and an outer conduit wherein both the inner conduit and the outer conduit are in fluid communication with the pump inlet, wherein the outer conduit substantially encloses the inner conduit, wherein the first inlet conduit assembly is in fluid communication with the outer conduit, and wherein the ejector outlet is in fluid communication with the inner conduit.

7. The ballast system according to claim 6, wherein the inner conduit has an inner conduit inlet and an inner conduit outlet, and wherein the outer conduit comprises a tapered portion at a location of the inner conduit outlet.

8. The ballast system according to claim 1, wherein the first inlet conduit assembly comprises an inlet separator, and wherein the inlet separator is in fluid communication with the ballast tank and the pump inlet.

9. The ballast system according to claim 8, wherein the ballast system further comprises an outlet conduit assembly in fluid communication with the inlet separator.

10. The ballast system according to claim 9, wherein the outlet conduit assembly further comprises a priming ejector comprising a priming ejector motive fluid inlet, a priming ejector entrained suction fluid inlet and a priming ejector outlet, and wherein the priming ejector entrained suction fluid inlet is in fluid communication with the inlet separator.

11. The ballast system according to claim 10, wherein the priming ejector motive fluid inlet is in fluid communication with the pump outlet.

12. The ballast system according to claim 10, wherein the ballast system further comprises a restoring conduit assembly comprising a restoring separator and a liquid seal, wherein the liquid seal is in fluid communication with the inlet separator and the restoring separator, and wherein the priming ejector outlet is in fluid communication with the restoring separator.

13. The ballast system according to claim 12, wherein the ballast system further comprises a cut-off conduit assembly in fluid communication between the liquid seal and the outlet conduit assembly.

14. The ballast system according to claim 12, wherein the restoring conduit further comprises an outlet conduit in fluid communication between the restoring separator and an environment ambient of the ballast system.

15. The ballast system according to claim 1, wherein at least a portion of the first inlet conduit is located at a first elevation, and wherein the pump inlet is located at a second elevation below the first elevation.

16. A marine structure comprising the ballast system according to claim 1.

17. A method for transporting fluid from a ballast tank of a ballast system to an environment ambient of the ballast system, the ballast system further comprising:

a pump comprising a pump inlet and a pump outlet, a first inlet conduit assembly providing fluid communication between the ballast tank and the pump inlet, the method comprising:

providing fluid communication between a second inlet conduit assembly in fluid communication with an auxiliary system and the pump inlet;

providing fluid communication between the pump outlet and the environment ambient of the ballast system; and providing that the pump is in an operating condition, such that fluid is conveyed from the pump inlet to the pump outlet.

18. The method according to claim 17, wherein the method further comprises:

determining a quality measure indicative of at least one property of the fluid transported from the ballast tank to the pump inlet;

comparing the quality measure with a predetermined interval, and if the quality measure falls within the predetermined interval, conveying at least a portion of the fluid at the pump outlet back to the pump inlet when the pump is in the operating condition.

19. The method according to claim 18, wherein the quality measure is indicative of the amount of a gas phase in the fluid approaching the pump inlet.

20. The method according to claim 19, wherein the ballast system comprises an inlet separator in fluid communication with the ballast tank and the pump inlet, and further comprising determining the amount of gas phase in the inlet separator for the quality measure.

* * * * *